US010421278B2

(12) United States Patent
Chen et al.

(10) Patent No.: US 10,421,278 B2
(45) Date of Patent: Sep. 24, 2019

(54) FLUID EJECTION DIE AND PLASTIC-BASED SUBSTRATE

(71) Applicant: Hewlett-Packard Development Company, L.P., Houston, TX (US)

(72) Inventors: Chien-Hua Chen, Corvallis, OR (US); Michael W. Cumbie, Corvallis, OR (US); Devin A. Mourey, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/761,602

(22) PCT Filed: Nov. 2, 2015

(86) PCT No.: PCT/US2015/058553
§ 371 (c)(1),
(2) Date: Mar. 20, 2018

(87) PCT Pub. No.: WO2017/078661
PCT Pub. Date: May 11, 2017

(65) Prior Publication Data

US 2018/0354268 A1 Dec. 13, 2018

(51) Int. Cl.

| | |
|---|---|
| ***B41J 2/16*** | (2006.01) |
| ***B41J 2/155*** | (2006.01) |
| *B41J 2/14* | (2006.01) |

(52) U.S. Cl.
CPC ..... *B41J 2/1637* (2013.01); *B41J 2/155* (2013.01); *B41J 2/16* (2013.01); *B41J 2/1623* (2013.01);

(Continued)

(58) Field of Classification Search
CPC ..... B41J 2/1632; B41J 2/1433; B41J 2/162; B41J 2202/03; Y10T 29/49401
See application file for complete search history.

(56) References Cited

U.S. PATENT DOCUMENTS

| | | | |
|---|---|---|---|
| 5,729,261 | A | 3/1998 | Burke et al. |
| 6,315,393 | B1 | 11/2001 | Van et al. |

(Continued)

FOREIGN PATENT DOCUMENTS

| | | |
|---|---|---|
| JP | H6255106 | 9/1994 |
| JP | H6328679 | 11/1994 |
| WO | WO-2014133576 | 9/2014 |

OTHER PUBLICATIONS

Lim, et al., "T-jet a Novel Thermal Inkjet Printhead with Monolithically Fabricatehozzle Plate on SOI Wafer", Jun. 8-12, 2003, 4 pages, The 12th International Conference on Solid State Sensors, Actuators and Microsystems, Boston.

*Primary Examiner* — John Zimmermann
(74) *Attorney, Agent, or Firm* — HP Inc. Patent Department

(57) ABSTRACT

Examples include a plastic-based support substrate and at least one fluid ejection die coupled thereto. The at least one fluid ejection die comprises a nozzles for dispensing printing material. The plastic-based support substrate has a fluid communication channel formed therethrough, where the fluid communication channel is in fluid communication with the nozzles of the at least one fluid ejection die.

15 Claims, 7 Drawing Sheets

(52) U.S. Cl.
CPC ..... *B41J 2/1632* (2013.01); *B41J 2/1635* (2013.01); *B41J 2002/14491* (2013.01); *B41J 2202/20* (2013.01)

(56) References Cited

U.S. PATENT DOCUMENTS

| | | | | |
|---|---|---|---|---|
| 7,658,470 | B1 * | 2/2010 | Jones | B41J 2/14072 347/50 |
| 8,657,413 | B2 | 2/2014 | Graham et al. | |
| 8,819,935 | B2 | 9/2014 | Fujita et al. | |
| 2002/0075368 | A1 | 6/2002 | Su et al. | |
| 2002/0180825 | A1 | 12/2002 | Buswell et al. | |
| 2004/0021740 | A1 | 2/2004 | Bell et al. | |
| 2006/0028510 | A1 | 2/2006 | Park et al. | |
| 2006/0109315 | A1 | 5/2006 | Sato et al. | |
| 2006/0114294 | A1 | 6/2006 | Kim | |
| 2007/0026561 | A1 | 2/2007 | Kamei | |
| 2008/0079781 | A1 | 4/2008 | Shim et al. | |
| 2009/0058921 | A1 * | 3/2009 | Habashi | B41J 2/16585 347/29 |
| 2011/0018941 | A1 | 1/2011 | McAvoy et al. | |
| 2011/0037808 | A1 | 2/2011 | Ciminelli et al. | |
| 2011/0298868 | A1 * | 12/2011 | Fielder | B41J 2/155 347/45 |
| 2013/0106958 | A1 | 5/2013 | Kitada et al. | |

* cited by examiner

FLUID EJECTION DIE AND PLASTIC-BASED SUBSTRATE

BACKGROUND

Printers are devices that deposit a fluid, such as ink, on a print medium, such as paper. A printer may include a printhead that is connected to a printing material reservoir. The printing material may be expelled, dispensed, and/or ejected from the printhead onto a physical medium.

DRAWINGS

Throughout the drawings, identical reference numbers designate similar, but not necessarily identical, elements. The figures are not necessarily to scale, and the size of some parts may be exaggerated to more clearly illustrate the example shown.

DESCRIPTION

Figure 1:
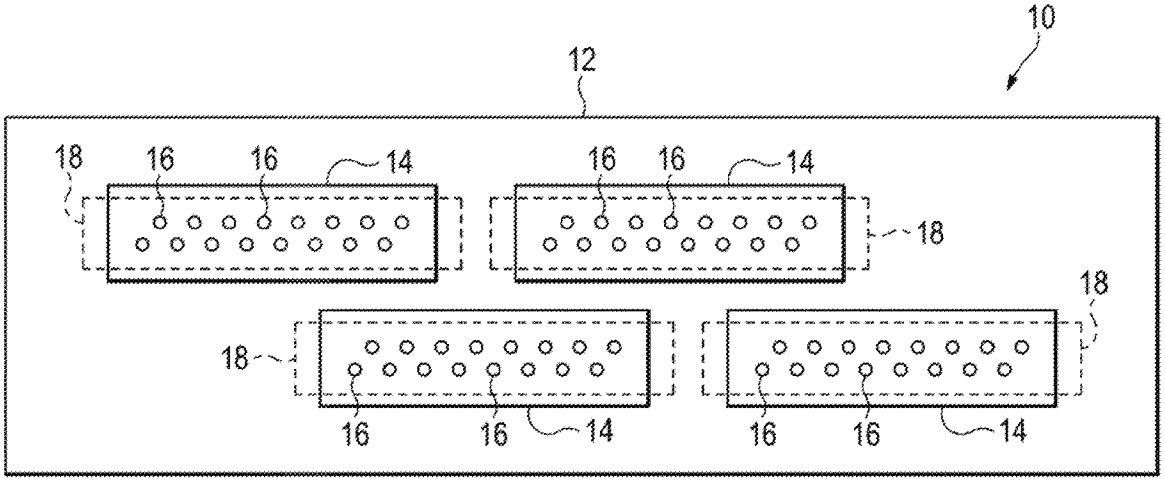
FIG. 1 is a top view of some components of an example fluid ejection device.

Examples of fluid ejection devices generally comprise at least one fluid ejection die and a plastic-based support substrate coupled to the at least one fluid ejection die. Some examples of a fluid ejection device are printheads, where a printhead may comprise at least one fluid ejection die coupled to a plastic-based support substrate. Each fluid ejection die comprises a plurality of nozzles, where each nozzle may dispense printing material. Printing material, as used herein, may comprise ink, toner, fluids, powders, colorants, varnishes, finishes, gloss enhancers, binders, and/or other such materials that may be utilized in a printing process. Each fluid ejection die comprises at least one fluid feed hole for each respective nozzle of the plurality of nozzles. Each fluid feed hole is in fluid, communication with the respective nozzle to thereby convey printing material to the nozzle for dispensation by the respective nozzle. The plastic-based support substrate has a fluid communication channel formed therethrough in fluid communication with the at least one feed hole. In such examples, a printing material reservoir may be fluidly connected to the nozzles of the fluid ejection device via the fluid communication channel, and the fluid feed holes.

Examples provided herein include fluid ejection devices, such as printheads, that comprise a plastic-based support substrate and a plurality of fluid ejection dies coupled to the support substrate. Each fluid ejection die of the plurality may comprise a plurality of nozzles to dispense printing material. The plastic-based support substrate may have a plurality of fluid communication channels formed therethrough, where each fluid ejection die of the plurality may be in fluid communication with a respective fluid communication channel. As will be appreciated, printing material may be conveyed via the fluid communication channels to nozzles of each fluid ejection die for dispensation therewith.

Generally, nozzles eject printing material under control of a controller or other integrated circuit to form printed content with the printing material on a physical medium. Nozzles generally include ejectors to cause printing material to be ejected/dispensed from a nozzle orifice. Some examples of types of ejectors implemented fluid ejection devices include thermal ejectors, piezoelectric ejectors, and/or other such ejectors that may cause printing material to eject/be dispensed from a nozzle orifice. In some examples, fluid ejection dies may be referred to as slivers. In some examples the fluid ejection dies may be formed with silicon or a silicon-based material. Various features, such as nozzles may be formed from various materials used in silicon device based fabrication, such as silicon dioxide, silicon nitride, metals, epoxy, polyimide, other carbon-based materials, etc. Generally, a sliver may correspond to a fluid ejection die having: a thickness of approximately 650 μm or less; exterior dimensions of approximately 30 mm or less; and/or a length to width ratio of approximately 3 to 1 or larger.

Example fluid ejection devices, as described herein, may be implemented in printing devices, such as two-dimensional printers and/or three-dimensional printers (3D). In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected. In some examples, a printing device in which a fluid ejection device may be implemented may print content by deposition of consumable fluids in a layer-wise additive manufacturing process. Generally, consumable fluids and/or consumable materials may include all materials and/or compounds used, including, for example, ink, toner, fluids or powders, or other raw material for printing. Generally, printing material, as described herein may comprise consumable fluids as well as other consumable materials. Printing material may comprise ink, toner, fluids, powders, colorants, varnishes, finishes, gloss enhancers, binders, and/or other such materials that may be utilized in a printing process.

Generally, the plastic-based support substrate of a fluid ejection device may comprise one or more plastic-based materials. Examples of such plastic-based materials include liquid crystal polymers-based material; polyimide-based material; acrylonitrile butadiene styrene and styrene acrylonitrile-based material; polycarbonate-based material; polyamide-based material; polymethyl methacrylate-based material; polyacetal/polyoxymethylene-based material; polybutylene terephthalate-based material; polyethylene terephthalate-based material; polyphenylene oxide-based material; fluorpolymer-based material; polyphenylene sulfide-based material; polyketones-based material; and/or other such synthetic polymer based materials.

Turning now to the figures, and particularly to FIG. 1, this figure provides a top view of some components of an example fluid ejection device 10. As shown in this example, the fluid ejection device 10 comprises a plastic-based support substrate 12 and a plurality of fluid ejection dies 14 coupled thereto. As shown, each fluid ejection die 14 comprises a plurality of nozzles 16, where the nozzles 16 are to dispense printing material. In this example, fluid communication channels 18 that are formed through the plastic-based support substrate 12 are illustrated in phantom, where the fluid ejection device 10 has a fluid communication channel 18 for each fluid ejection die 14. As will be appreciated, the fluid communication channel 18 for each fluid ejection die 14 is in fluid communication with the nozzles of the fluid ejection die 14 such that printing material may be conveyed to the nozzles of the fluid ejection die 14 for dispensing thereby.

Figure 2:
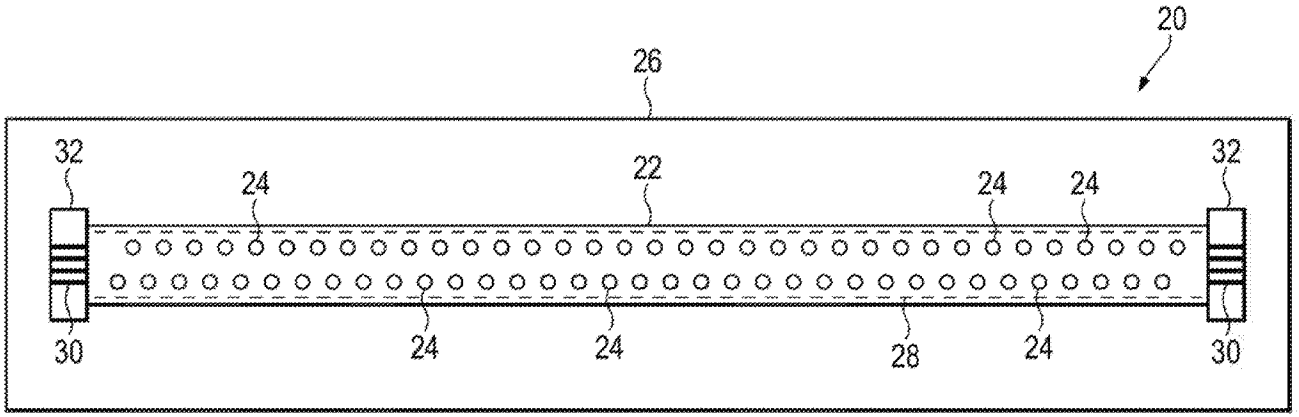
FIG. 2 is a top view of some components of an example fluid ejection device.

FIG. 2 provides a top view of some components of an example fluid ejection device 20. As shown, the example fluid ejection device 20 comprises at least one fluid ejection die 22, where the fluid ejection die 22 comprises a plurality of nozzles 24 to dispense printing material. The fluid ejection die 22 is coupled to a plastic-based support substrate 26. In addition, a fluid communication channel 28 is illustrated with a dashed line, where the fluid communication channel 28 passes through the plastic-based support substrate and is in fluid communication with the nozzles 24 of the fluid ejection die 22. In this example, conductive traces 30 are connected to the fluid ejection die 22. Generally, the conductive traces 30 may electrically connect the fluid ejection die 22 to a controller, integrated circuit, print engine, or other such hardware components that may control the dispensation of printing material from nozzles 24 of the fluid ejection die 22. Furthermore, the conductive traces 30 generally pass through conductive trace openings formed in the plastic-based support substrate, such that the conductive traces may electrically connect to the fluid ejection die 22 on a top surface of the plastic-based support substrate 28, and the conductive traces may be routed to a controller on a bottom surface of the plastic-based support substrate. In the example fluid ejection device 20 of FIG. 2, the conductive traces 30 may be encapsulated with an insulating material 32. Generally, the encapsulation may electrically insulate the connection of the conductive traces 30 and the fluid ejection die 22, and the encapsulation may seal the connection of the conductive traces 30 and the fluid ejection die 22 to protect the conductive traces 30 and/or the fluid ejection die from environmental conditions/elements (such as printing material and/or moisture). While not shown in the example, an integrated circuit (IC), controller, or other such component may be electrically connected to the fluid ejection die 22 via the conductive traces 30.

Figure 3:
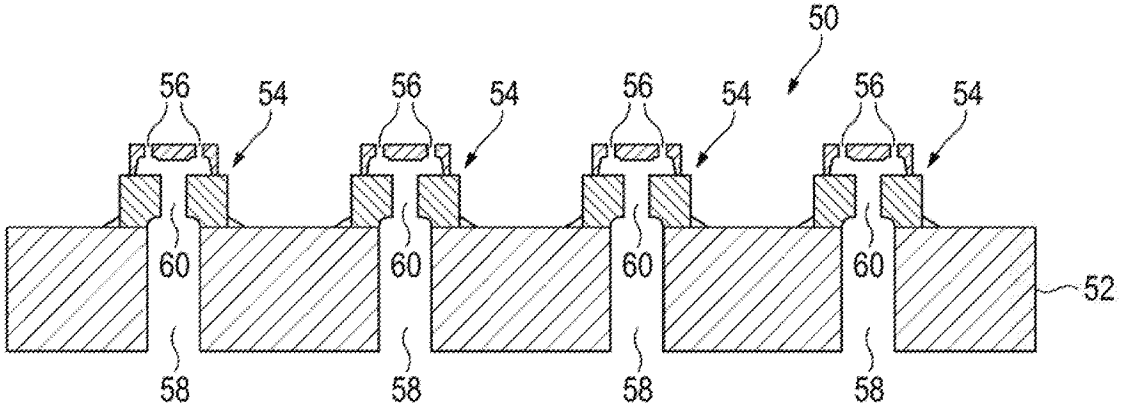
FIG. 3 is cross-sectional view of an example fluid ejection device.

FIG. 3 provides a cross-sectional view of an example fluid ejection device 50. As shown, the fluid ejection device 50 comprises a plastic-based support substrate 52 and a plurality of fluid ejection dies 54 coupled to the plastic-based support substrate 52. As shown, each fluid ejection die 54 comprises nozzles 56 to dispense printing material. In this example, the plastic-based support substrate 52 has a fluid communication channel 58 formed therethrough for each fluid ejection die 54. Each fluid ejection die 54 has at least one fluid feed hole 60 formed therethrough, where the fluid feed hole 60 is in fluid communication with the nozzles 56 of the fluid ejection die 54 and the fluid communication channel 58 of the plastic-base support substrate 52. Accordingly, printing material may be conveyed from a printing material reservoir to the nozzles 56 for dispensing via the fluid communication channels 58 and the fluid feed holes 60.

Figure 4:
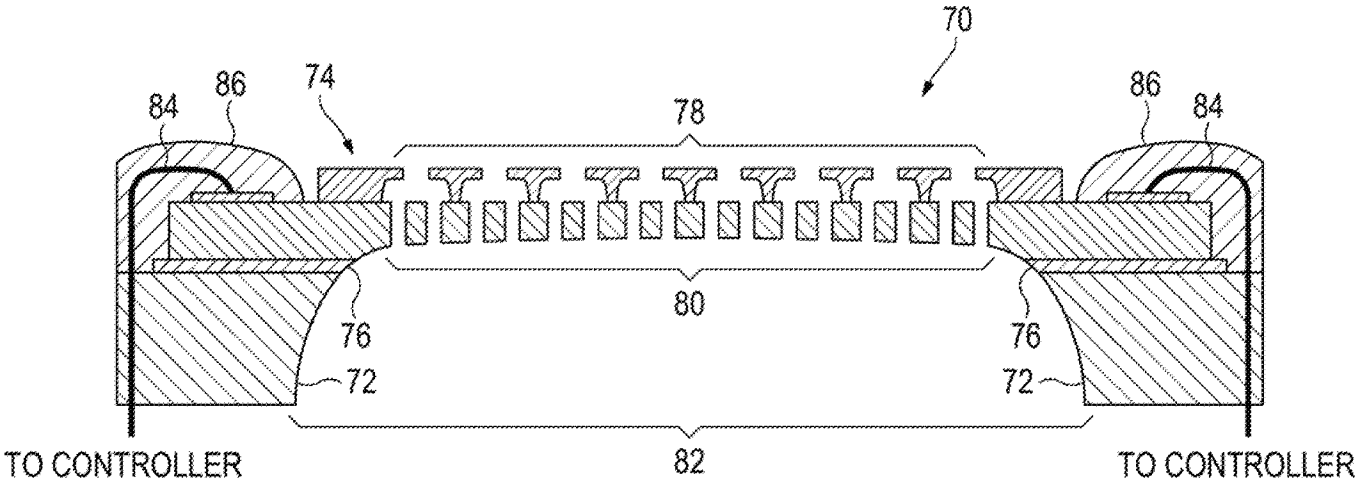
FIG. 4 is a cross-sectional view of an example fluid ejection device.

FIG. 4 provides a cross sectional view of ark example fluid ejection device 70. In this example, the fluid ejection device 70 comprises a plastic-based support substrate 72 and a fluid ejection die 74 coupled to the plastic-based support substrate 72. As will be appreciated, the fluid ejection device 70 may comprise additional fluid ejection dies not visible in the cross sectional view. In this example, the fluid ejection die 74 is coupled to the plastic-based support substrate 72 with an adhesive 76. In some examples of fluid ejection devices and/or fluid ejection devices described herein example adhesives may include adhesive tape, epoxy-based compound, such as Loctite DP10005, etc.

While in this example the fluid ejection die 74 is coupled to the plastic-based support substrate 72 with adhesive 76, it will be appreciated that in other examples a fluid ejection die may be coupled to a plastic-based support substrate by bonding, overmolding, etc. In some examples, the adhesive may correspond to an adhesive tape, where the adhesive tape may include a first adhesive material on a first surface of the tape with which to couple to the fluid ejection dies, and the adhesive tape may include a second adhesive material on a second surface of the tape with which to couple to the plastic-based support substrate.

Returning to FIG. 4, as shown, the fluid ejection die 74 comprises a plurality of nozzles 78, where the nozzles 78 may dispense printing material. Fluid feed holes 80 are formed through the fluid ejection die 74, and a fluid communication channel 82 is formed through the plastic-based support substrate 72. The fluid feed holes 80 are in fluid communication with the nozzles 78 and the fluid communication channel 82 such that printing material may be conveyed to the nozzles 78 via the fluid communication channel 82 and the fluid feed holes 80.

In this example, conductive traces 84 are electrically connected to the fluid ejection die 74. In addition, the conductive traces 84 pass through conductive trace openings formed through the plastic-based support substrate 72. In addition, the fluid ejection device 70 comprises an insulating material 86 that encapsulates a portion of the conductive traces 84 and the fluid ejection die 74 such that the electrical connection between the fluid ejection die 74 and the conductive traces 84 is electrically insulated. As will be appreciated, the encapsulation with the insulating material may further seal and protect the conductive traces 84 and the electrical connection of the conductive traces 84 to the fluid ejection die 74 from environmental conditions, such as printing material and/or moisture. Furthermore, as shown, the conductive traces 84 may be electrically connected to a controller such that the controller may control dispensing of printing material with nozzles 78 of the fluid ejection die 74. As will be appreciated, a controller may comprise an application specific, integrated circuit (ASIC), a general purpose processor, and/or other such logical components for data processing. The controller may control ejectors of the nozzles 78 to selectively dispense printing material from the nozzles 78.

Figure 5:
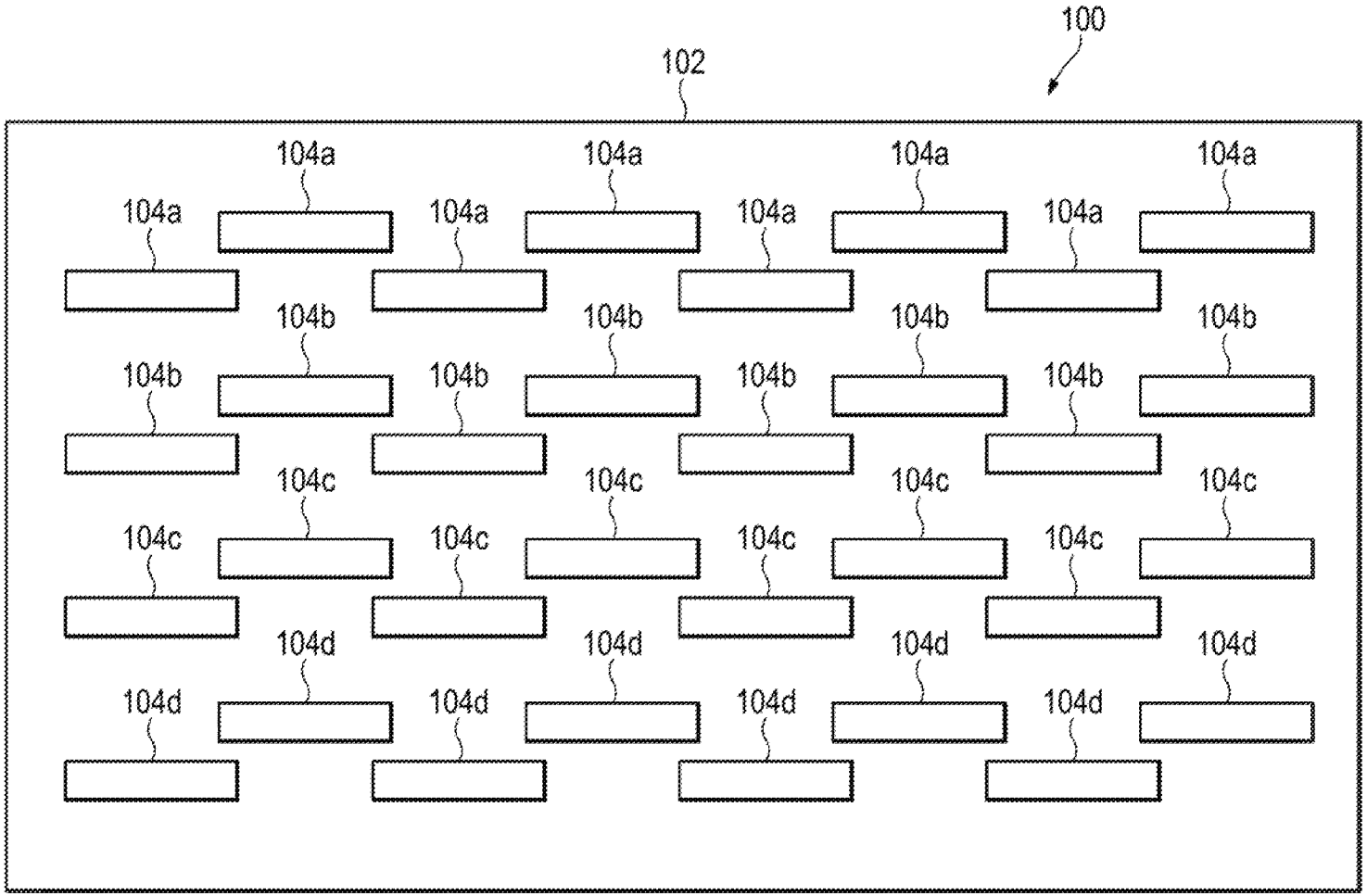
FIG. 5 is a top view of some components of an example fluid ejection device.

FIG. 5 provides a top view of a fluid ejection device 100. In this example, the fluid ejection device 100 comprises a plastic-based support substrate 102 and a plurality of fluid ejection dies 104*a-d* coupled to the plastic-based support substrate 102. As shown, the fluid ejection dies 104*a-d* are generally arranged end-to-end along a width of the plastic-based support substrate 102. In some examples, the fluid ejection device 100 may be implemented in a page-wide, fixed printhead, printing device. In such examples, the fluid ejection dies 104*a-d* may be arranged generally end-to-end along the width of the fluid ejection device 100 and plastic-based support substrate 102, where the width of the fluid ejection device 100 corresponds to a printing width of a printing device into which the fluid ejection device 100 may be implemented.

Furthermore, in some examples, such as the example shown in FIG. 5, the fluid ejection dies 104*a-d* may be arranged in sets that correspond to a printing order. For example, a first set of fluid ejection dies 104*a* may correspond to a first printing order; a second set of fluid ejection dies 104*b* may correspond to a second printing order; a third set of fluid ejection dies 104*c* may correspond to a third printing order; and a fourth set of fluid ejection dies 104*d* may correspond to a fourth printing order. Generally, a printing order may correspond to an order in which a color of a printing material and/or a type of printing material is dispensed onto a physical medium during a printing process. For example, in a cyan, magenta, yellow, and black (CMYK) color printing process: a black color printing material may have a first printing order; a cyan printing material may have a second printing order; a magenta color printing material may have a third printing order; and a yellow color printing material may have a fourth printing order. To illustrate by way of example, if the example fluid ejection device 100 of FIG. 5 were implemented in a CMYK printing process, the first set of fluid ejection dies 104*a* may dispense a black color printing material the second set of fluid ejection dies 104*b* may dispense cyan color printing material; the third set of fluid ejection dies 104*c* may dispense a magenta color printing material; and the fourth set of fluid ejection dies 104*d* may dispense a yellow color printing material.

While the example of fluid ejection device 100 is illustrated with four sets of fluid ejection dies 104*a-d,* other examples may comprise various arrangements of fluid ejection dies based on the printing processes and printing devices into which the examples may be implemented. Moreover, while examples have been described with regard to dispensation of colorant printing materials, other examples may dispense other types of printing materials, such as binders, gloss enhancers, varnishes, etc.

Figure 6:
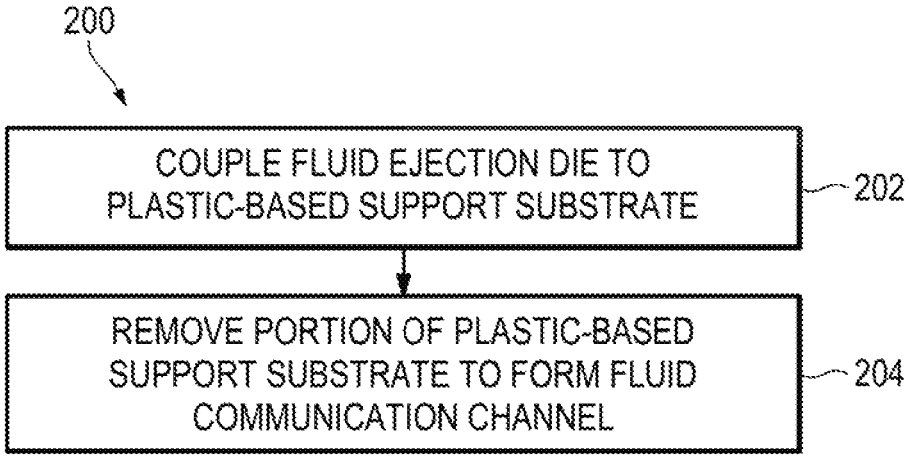
FIG. 6 is a flowchart of an example process.

FIG. 6 provides a flowchart that illustrates an example process 200 that may be performed to form a fluid ejection device. At least one fluid ejection die is coupled to a plastic-based support substrate (block 202), and a portion of the plastic-based support substrate is removed to form a fluid communication channel (block 204). As will be appreciated, the fluid communication channel is in fluid communication with nozzles of the at least one fluid, ejection die.

Figure 7:
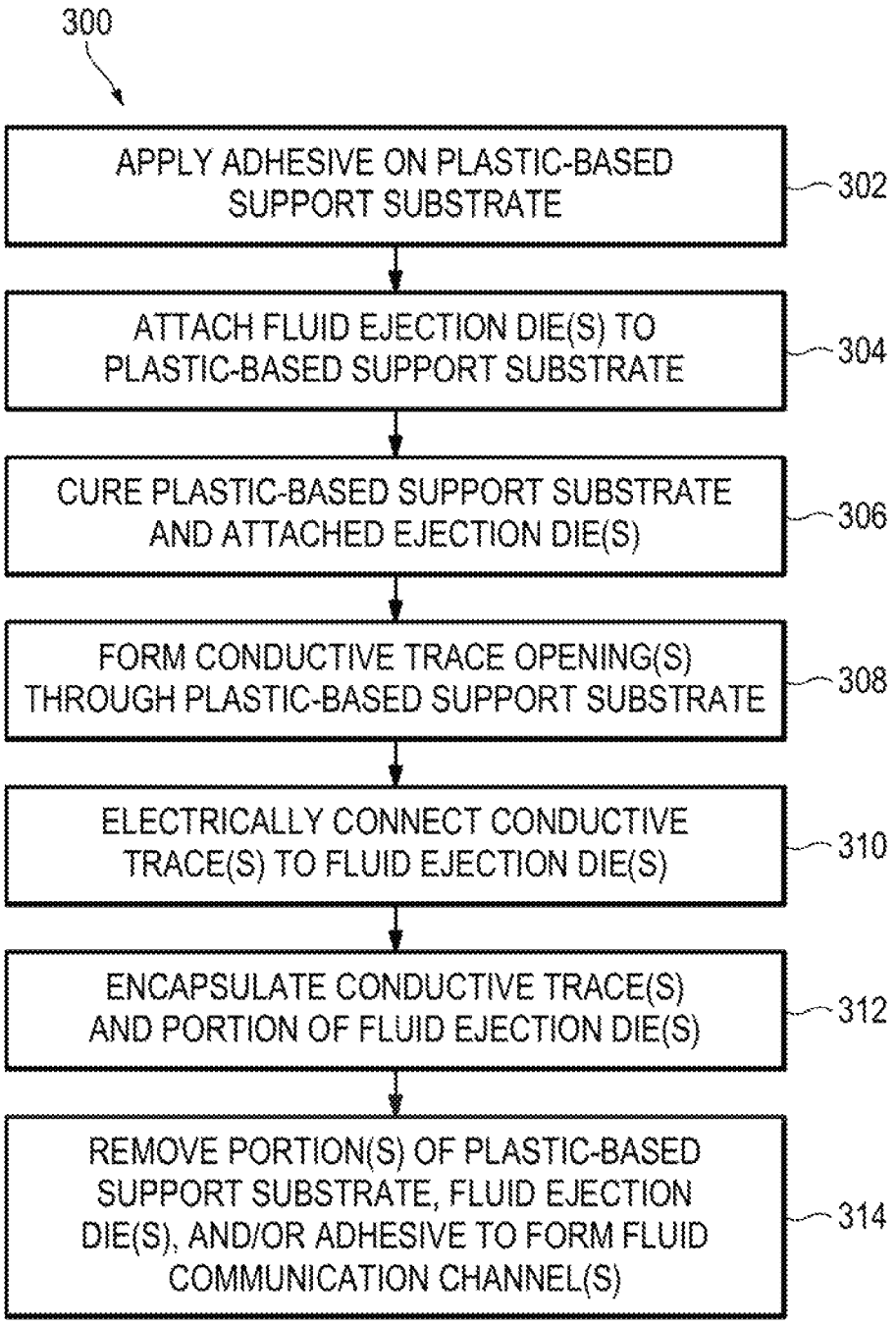
FIG. 7 is a flowchart of an example process.

FIG. 7 provides a flowchart that illustrates an example process 300 that may be performed to form a fluid ejection device. An adhesive is applied to a plastic based support substrate (block 302). Generally, the adhesive is applied at a position of the plastic based support substrate where a fluid ejection die is to be coupled. Fluid ejection dies are attached to the plastic-based support substrate via the adhesive (block 304), and the attached fluid ejection dies and plastic based support substrate are cured (block 306) such that the adhesive bond between the fluid ejection dies, plastic-based support substrate, and adhesive is strengthened. In some examples, curing the plastic-based support substrate and attached fluid ejection dies may comprise curing Loctite DP 10005 at 120° C. for 60 minutes.

Conductive trace openings are formed through the plastic-based support substrate (block 308). In some examples, conductive trace openings may be formed by laser cutting such openings through the plastic-based support substrate, and conductive traces may be routed therethrough. Conductive traces are electrically connected to the, fluid ejection dies (block 310). In some examples, electrically connecting the fluid ejection dies comprises wire bonding conductive traces to bond pads of the fluid ejection dies. The conductive traces and at least a portion of the fluid ejection dies associated with the electrical connection are encapsulated with an insulating material (block 312). In some examples, the insulating material is applied to cover the bond pad, and the conductive traces bonded thereto. In some examples, encapsulating the conductive traces and portions of the fluid ejection dies may comprise encapsulating with Henkel FP1530, which may be cured at 180° C. for 7 minutes.

Portions of the plastic-based support substrate, the adhesive, and/or the fluid ejection dies may be removed to form fluid communication, channels through the plastic-based support substrate (block 314). In some examples, removing portions of the plastic-based support substrate, fluid ejection dies, and/or adhesive may comprise plunge-cut slotting the plastic-based support substrate, fluid ejection dies, and/or adhesive. In other examples, removing portions of the plastic-based support substrate, fluid ejection dies, and/or adhesive may comprise laser-cutting the plastic based support substrate, fluid ejection dies, and/or adhesive. Other examples may implement other types of micromachining to form the fluid communication channels. As will be appreciated, the fluid communication channels are formed such that the fluid communication channels are in fluid communication with nozzles and feed slots of the fluid ejection dies.

Figure 8:
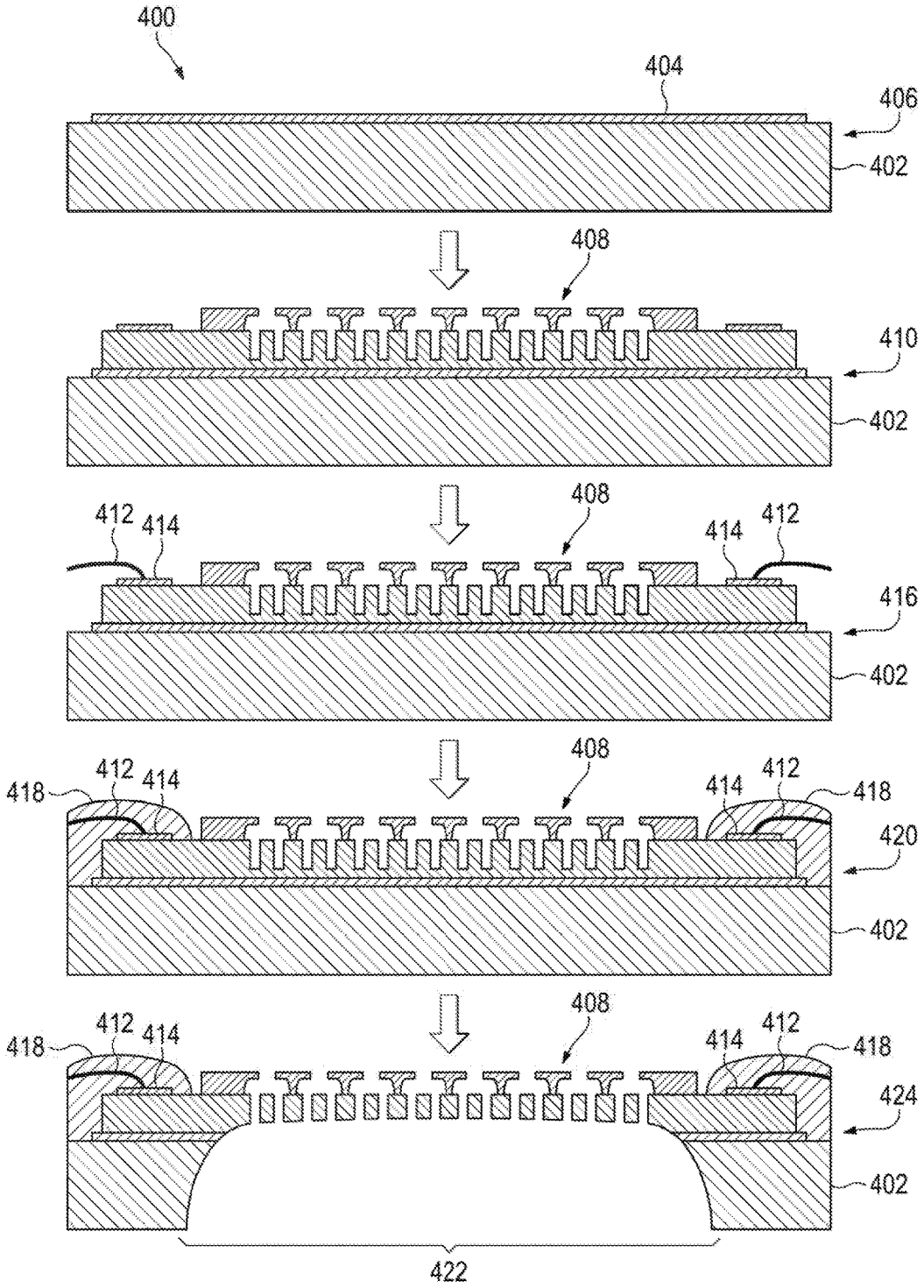
FIG. 8 is a flow diagram for an example process for forming a fluid ejection device.

FIG. 8 provides a flow diagram of an example process 400 for forming a fluid ejection device. In this example, a plastic based support substrate 402 is processed by dispensing adhesive 404 onto a top surface of the plastic-based support substrate 402 (block 406). A fluid ejection die 408 is coupled to the plastic-based support manifold 402 with the adhesive 404 (block 410). The fluid ejection die 408 is electrically connected to conductive traces 412 (e.g., conductive wire) by coupling a respective conductive trace 412 to a bond pad 414 of the fluid ejection die 408 (block 416). In addition, the conductive elements 412 and bond pads 414 may be encapsulated with an insulating material 418 (block 420). A fluid communication channel 422 is formed through the plastic-based support substrate 402 and fluidly connected to nozzles of the fluid ejection die 408 (block 424).

Figure 9:
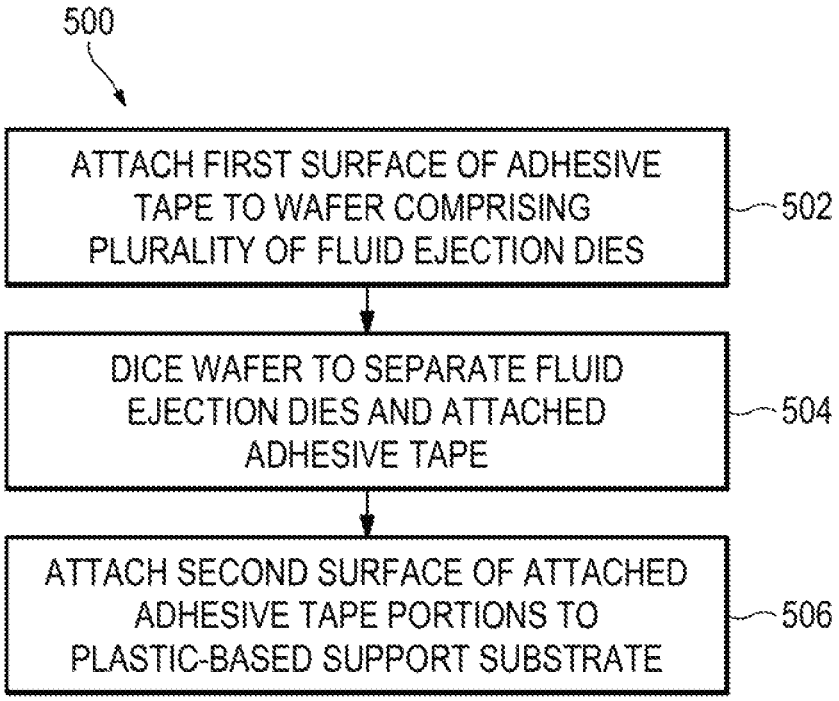
FIG. 9 is a flowchart of an example process.

FIG. 9 provides a flowchart that illustrates an example process 500 that may be performed during fabrication of a fluid ejection device and/or fluid ejection device. In this example, an adhesive tape may comprise a first adhesive material on a first surface of the adhesive tape and a second adhesive material on a second surface of the adhesive tape. Furthermore, a plurality of fluid ejection dies may be formed on a wafer. In the example, the first surface of the adhesive tape is attached to the wafer that comprises the plurality of fluid ejection dies (block 502). The fluid ejection dies and attached adhesive tape may be separated by dicing wafer (block 504). After separating the fluid ejection dies, with adhesive tape attached thereto, the fluid ejection dies are coupled to the plastic based support substrate in a desired arrangement by attaching the second surface of the adhesive tape to the plastic-based support substrate (block 506). As will be appreciated, in examples similar to the example process of FIG. 9, the first adhesive material and the second adhesive material of the adhesive tape may be selected based on the materials of the fluid ejection die and the plastic-based support substrate to which the adhesive tape is to be attached.

Accordingly, examples provided herein may implement a plastic-based support substrate having fluid communication channels formed therethrough. As will be appreciated, coupling of fluid ejection dies to a plastic-based support substrate having fluid communication channels formed therethrough may facilitate printing material conveyance to nozzles for dispensation. In addition, such fluid ejection die and plastic-based support substrate fluid ejection devices may be structurally resistant to materials used in printing materials. Furthermore, in some examples, the fluid ejection dies may be directly coupled to the plastic-based support substrate with an adhesive, where the fluid communication channels of the plastic-based support substrate facilitate delivery of printing material from a printing material reservoir to nozzles of the fluid ejection dies.

Various types of plastic-based materials may be implemented in plastic-based support substrate. Examples of such materials include liquid crystal polymers-based material; polyimide-based material; acrylonitrile butadiene styrene and styrene acrylonitrile-based material; polycarbonate-based material; polyamide-based material; polymethyl methacrylate-based material; polyacetal/polyoxymethylene-based polybutylene terephthalate-based material; polyethylene terephthalate-based material; polyphenylene oxide-based material; fluorpolymer-based material; polyphenylene sulfide-based material; polyketones-based material; or any combination thereof.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the claims.

The invention claimed is:

1. A fluid ejection device comprising:

a plastic-based support substrate having a plurality of fluid communication channels formed therethrough; and a plurality of fluid ejection dies coupled to the support substrate, each fluid ejection die of the plurality comprising a plurality of nozzles, each fluid ejection die of the plurality in fluid communication with a respective fluid communication channel and each of the respective fluid communication channels for one of the plurality of fluid ejection dies, and each nozzle to dispense printing material received from the respective channel.

2. The fluid ejection device of claim 1, further comprising:

a respective conductive trace electrically connected to each fluid ejection die of the plurality; and an insulating material encapsulating each respective conductive trace.

3. The fluid ejection device of claim 1, wherein the plastic-based support substrate has a width, and the fluid ejection dies of the plurality are generally arranged end-to-end along the width of the plastic-based support substrate.

4. The fluid ejection device of claim 1, wherein the plurality of fluid ejection dies comprise a first set of fluid ejection dies and a second set of fluid ejection dies, the plastic-based support substrate has a width, the first set of fluid ejection dies are generally arranged end-to-end along the width of the support substrate in a first print order position, and the second set of fluid ejection dies are generally arranged end-to-end along the width of the support substrate in a second print order position.

5. The fluid ejection device of claim 1, wherein the plurality of fluid ejection dies are coupled to the support substrate with an adhesive tape.

6. A process comprising:

coupling fluid ejection dies to a plastic-based support substrate, the fluid ejection dies comprising nozzles to dispense printing material; and removing a portion of the plastic-based support substrate to thereby form fluid communication channels passing through the plastic-based support substrate, the fluid communication channels fluidly connected to the fluid election dies such that each fluid ejection die is in fluid communication with a respective one of the fluid communication channels and each of the fluid communication channels is for one of the fluid election dies.

7. The process of claim 6, wherein removing the portion of the plastic-based support substrate to thereby form the fluid communication channels comprises slot-plunge cutting the plastic-based support substrate.

8. The process of claim 6, wherein coupling the fluid ejection dies to the plastic-based support substrate comprises:

applying an adhesive to a surface of the plastic-based support substrate;

attaching the fluid ejection dies to the applied adhesive: and curing the plastic-based support substrate and the attached fluid ejection dies.

9. The process of claim 6, wherein the fluid ejection dies are generally arranged end-to-end across a width of the plastic-based support substrate.

10. The process of claim 6, further comprising:

electrically connecting conductive traces to the fluid ejection dies; and encapsulating the conductive traces and a portion of the fluid ejection dies with an insulating material to thereby electrically insulate the connection therebetween.

11. The process of claim 6, further comprising:

forming a conductive trace opening through the support substrate; and electrically connecting a conductive trace to one of the fluid ejection dies, wherein the conductive trace passes through the conductive trace opening.

12. The process of claim 6, further comprising:

attaching a first surface of an adhesive tape to a first surface of a wafer that comprises the fluid ejection dies; and dicing the wafer to separate the fluid ejection dies, wherein coupling the fluid ejection dies to the plastic-based support substrate comprises attaching a second surface of the adhesive tape to the plastic-based support substrate.

13. The process of claim 6, wherein the plastic-based support substrate comprises at least one of: liquid crystal polymers-based material; polyimide-based material; acrylonitrile butadiene styrene and styrene acrylonitrile-based material;

polycarbonate-based material; polyimide-based material; polymethyl methacrylate-based material; polyacetal/polyoxymethylene-based material; polybutylene terephthalate-based material; polyethylene terephthalate-based material; polyphenylene oxide-based material;

fluorpolymer-based material; polyphenylene sulfide-based material; polyketones-based material; or any combination thereof.

14. A fluid ejection device comprising:

a plurality of fluid ejection dies, each fluid ejection die of the plurality comprising a plurality of nozzles and a fluid feed hole in fluid communication with each nozzle of the plurality of nozzles, and each nozzle is to dispense printing material; and a plastic-based support substrate coupled to the plurality of fluid ejection dies, the plastic-based support substrate having fluid communication channels formed therethrough in fluid communication with the plurality of fluid election dies each die of the plurality of fluid election dies corresponding to one fluid communication channel of the fluid communication channels and each fluid communication channel for one of the plurality of fluid ejection dies.

15. The fluid ejection device of claim 14, wherein the plastic-based support substrate comprises at least one of: liquid crystal polymers-based material; polyimide-based material; acrylonitrile butadiene styrene and styrene acrylonitrile-based material; polycarbonate-based material; polyamide-based material; polymethyl methacrylate-based material; polyacetal/ipolyoxymethylene-based material; polybutylene terephthalate-based material; polyethylene terephthalate-based material; polyphenylene oxide-based material; fluorpolymer-based material; polyphenylene sulfide-based material; polyketones-based material; or any combination thereof.

* * * * *